US005272488A

United States Patent [19]

Kim

[11] Patent Number: 5,272,488

[45] Date of Patent: Dec. 21, 1993

[54] PRESS DEVICE FOR PRINTING HEAD

[75] Inventor: Jai S. Kim, Kyonggi, Rep. of Korea

[73] Assignee: Gold Star Co., Ltd., Seoul, Rep. of Korea

[21] Appl. No.: 852,674

[22] Filed: Mar. 17, 1992

[30] Foreign Application Priority Data

Mar. 18, 1991 [KR] Rep. of Korea ..... 91-3580

[51] Int. Cl.[5] ..... B41J 25/304; B41J 25/316

[52] U.S. Cl. ..... 346/76 PH; 400/120

[58] Field of Search ..... 346/76 PH; 400/120

[56] References Cited

FOREIGN PATENT DOCUMENTS

| | | | |
|---|---|---|---|
| 3616924 | 4/1987 | Fed. Rep. of Germany | 346/76 PH |
| 0156781 | 9/1984 | Japan | 400/120 |
| 0176075 | 10/1984 | Japan | 346/76 PH |
| 0176076 | 10/1984 | Japan | 346/76 PH |
| 0164572 | 7/1987 | Japan | 400/120 |
| 0169664 | 7/1987 | Japan | 346/76 PH |

*Primary Examiner*—Benjamin R. Fuller
*Assistant Examiner*—Huan Tran
*Attorney, Agent, or Firm*—Poms, Smith, Lande & Rose

[57] ABSTRACT

A press device in a color video pointer which is capable of pressing uniformly a thermal sensitive head against a platen, thereby improving printing quality. The press device comprises a platen disposed to be in contact with a thermal sensitive head having a sufficient length to carry out printing of every line and adapted to feed a dye film and a printing sheet and a holder adapted to force the thermal sensitive head to be in contact with the platen and to be separated from the platen. The press device also comprises a pair of plates both fixedly mounted on opposite ends of the thermal sensitive head, respectively, protrusions extending from the plates to outward direction of the thermal sensitive head, throughout holes adapted to receive the protrusions such that opposite ends of the thermal sensitive head move upwardly and downwardly, independently of each other, and a center member fixed to the holder and adapted to force the thermal sensitive head to be in close contact with the platen. With this construction, the thermal sensitive head is coupled to the holder such that the thermal sensitive head is inclined throughout the length thereof, according to the direction and the angle of the inclination of the platen.

2 Claims, 3 Drawing Sheets

PRESS DEVICE FOR PRINTING HEAD

BACKGROUND OF THE INVENTION

1. Field of the invention

The present invention relates to a device for pressing a thermal sensitive head in a thermal print-type color video printer, and more particularly a press device in a thermal print-type color video printer, which is capable of uniformly pressing a printing sheet and a dye film against a thermal sensitive head.

2. Description of the Prior Art

Such a thermal print-type color video printer includes a thermal sensitive head which has a group of heating elements arranged along a transverse axis, so as to accomplish a printing, line by line. In this case, the thermal sensitive head has a substantial length that makes it difficult to contact a platen throughout the length thereof. As a result, it is impossible to press uniformly a printing sheet and a dye film against the thermal sensitive head, thereby causing the printing concentration in each printed line to be irregular.

This disadvantage will now be described, in conjunction with one conventional printing head pressing device illustrated in FIG. 4. As shown in the drawing, the pressing device comprises a first holder 102 and a second holder 102' both fixedly mounted at respective ends thereof on opposite ends of the rear surface (that is, the upper surface in FIG. 4) of a thermal sensitive head 101, by means of screws 107, respectively. At the respective other ends, both holders 102 and 102' have throughout holes 104 through which opposite ends of a shaft 103 fixed to a first support structure 108 extend, respectively. Beneath the thermal sensitive head 101, a platen 105 is rotatably mounted on a second support structure 109, by means of a shaft 106 extending throughout the central axis of the platen 105, such that the outer surface of the platen 105 is in contact with the lower surface of the thermal sensitive head.

In operation, the thermal sensitive head 101 hinges about the shaft 103 so that the lower surface thereof is pressed against the peripheral outer surface of the platen 105, during printing. Between the thermal sensitive head 101 and the platen 105, a dye film 110 and a printing sheet 111 are disposed together, under pressed condition. As the platen 105 rotates about the shaft 106 in a direction indicated by an arrow in FIG. 4, the dye film 110 and the printing sheet 111 are fed in a direction indicated by an arrow in FIG. 4. At this time, the thermal sensitive head 101 applies heat to the dye film 110, according to video signals, so that dye from the dye film 110 adheres to the printing sheet 111. Thus, a printing according to video signals is carried out on the printing sheet, line by line.

However, when the thermal sensitive head 101 is not fully in contact with the platen 105 throughout the length thereof, that is, when the thermal sensitive head 101 is not in contact with the platen 105 at one end thereof, as shown in FIGS. 4A and 4B, a picture printed on the printing sheet 111 by the thermal sensitive head 101 includes a deteriorated portion. This deteriorated picture portion is formed at the area where the thermal sensitive head 101 is not in contact with the platen 105.

In the above-mentioned conventional pressing device, it is difficult for the thermal sensitive head 101 to be in contact with the platen 105 uniformly throughout the length thereof, due to tolerance in manufacture and wear and friction occurring in use.

SUMMARY OF THE INVENTION

Therefore, an object of the present invention is to provide a press device in a color video printer, which is capable of pressing uniformly a thermal sensitive head against a platen.

In accordance with the present invention, this object can be accomplished by a thermal print-type printer having a thermal sensitive head with a sufficient length to carry out printing of every line, comprising: a platen disposed to be in contact with the thermal sensitive head for feeding a dye film and a printing sheet; a holder adapted to force the thermal sensitive head to be in contact with the platen and to be separated from the platen; and means for coupling the thermal sensitive to the holder such that the thermal sensitive head is inclined throughout the length thereof, according to the direction and the angle of the inclination of the platen, when thermal sensitive head is in contact with the platen.

BRIEF DESCRIPTION OF THE DRAWINGS

Other objects and aspects of the invention will become apparent from the following description of embodiments with reference to the accompanying drawings in which.

DETAILED DESCRIPTION OF THE PREFERRED EMBODIMENTS

Figure 1:
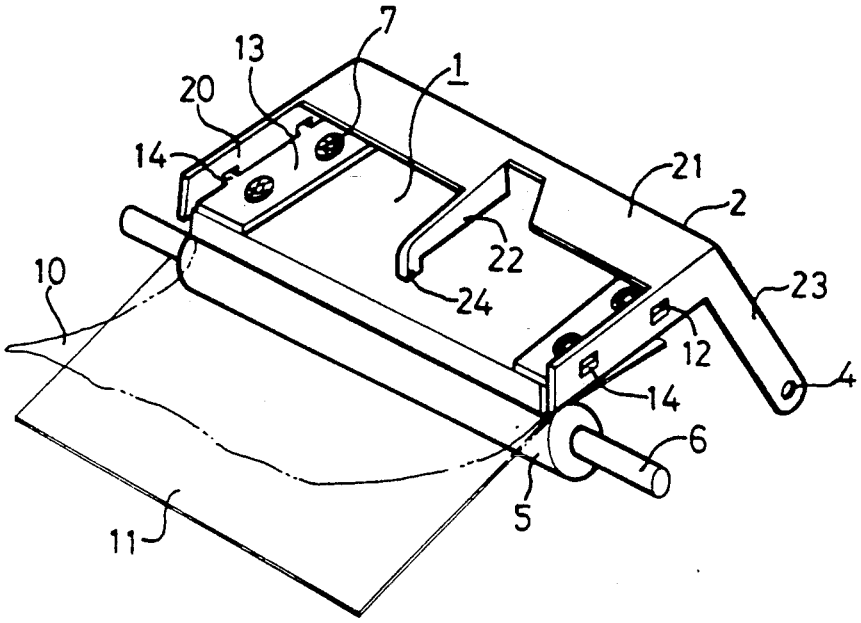
FIG. 1 is a perspective view of a thermal sensitive head pressing device in accordance with an embodiment of the present invention.
Figure 1A:
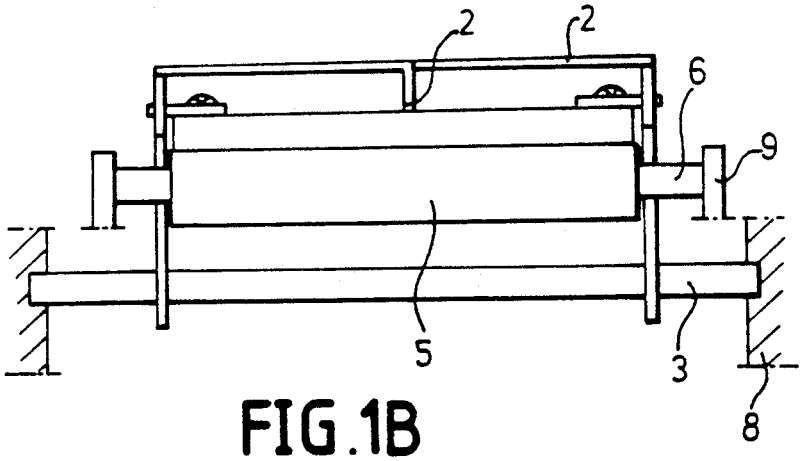
FIGS. 1A and 1B are a front view and a side view of the press device shown in FIG. 1, respectively.
Figure 1B:
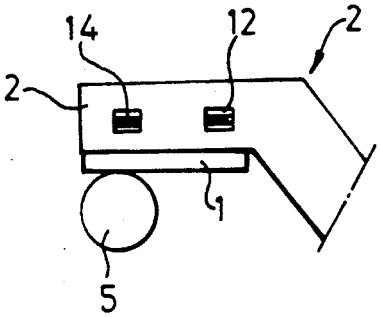

Referring to FIG. 1, there is illustrated a thermal sensitive head on which a thermal sensitive head pressing device of the present invention is mounted. Although not shown in the drawing, the thermal sensitive head, which is generally designated by the reference numeral "1, " includes a plurality of heating elements aligned with one another. As shown in FIG. 1, the press device comprises a pair of plates 13 and 13' both fixedly mounted on opposite ends of the rear surface (that is, the upper surface in FIG. 1) of the thermal sensitive head 1, by means of screws 7, respectively. Each plate 13 (or 13') has two protrusions 14 extending outwardly beyond the lateral edge of the thermal sensitive head 1.

In accordance with the present invention, the press device also comprises a holder 2 which includes two spaced side walls 20 each having two throughout holes 12 adapted to receive two protrusions 14 of each corresponding plate 13, respectively, an elongated bar 21 extending laterally and connected at opposite ends thereof integrally with respective upper ends of side walls 20, to support side walls 20, a center extension 22 extending from the center portion of the bar 21 (that is, the center point between opposite side walls 20) to the center portion of the thermal sensitive head 1, and a pair of supports 23 each extending outwardly and inclinedly from the end of each side wall 20 connected to the bar 21.

Each throughout hole 12 has a height allowing upward and downward movements of each corresponding protrusion 14 of each plate 13 therein. The center extension 22 has at its free end a center tip 24 extending downwardly toward the thermal sensitive head 1. In particular, the center tip 24 extends downwardly beyond the middle point of the height of throughout hole 12. Each support 23 also has a hole 4.

Through holes 4 of supports 23, a shaft 3 extends, which is fixed at opposite ends thereof to a first support structure 8, thereby functioning as a center point (that is, a center axis) for the action of holder 2 that is a hinge motion.

Beneath the thermal sensitive head 1, a platen 5 is rotatably mounted on a second support structure 9, by means of a shaft 6 extending throughout the central axis of the platen 5, such that the peripheral surface of the platen 5 is in contact with the lower surface of the thermal sensitive head I. The first support structure may be a housing of the printer, whereas the second support structure 9 may be the housing or other additional structure.

Figures 3, 3A:
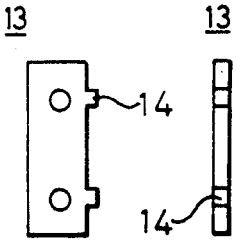
FIGS. 3, 3A and 3B which are a plan view, a front view and a side view of each plate shown in FIG. 1, respectively.
Figure 3B:
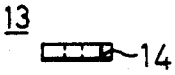
Figure 4:
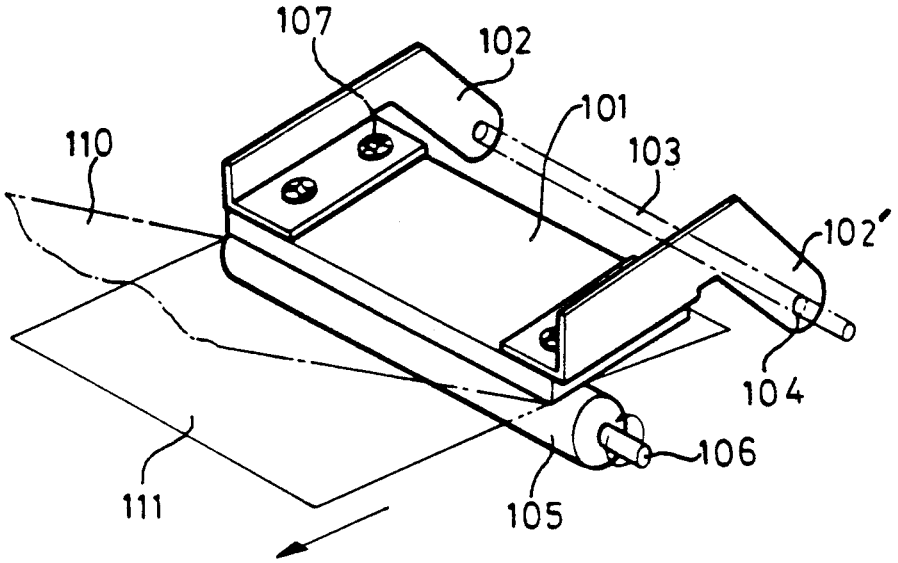
FIG. 4 is a perspective view of a conventional thermal sensitive head pressing device.
Figure 4A:
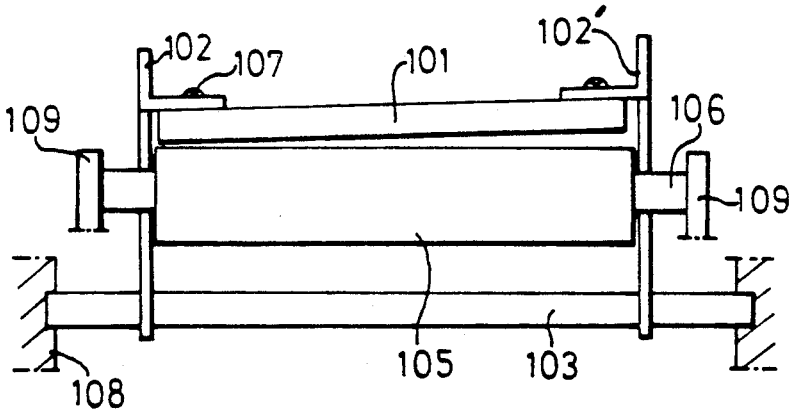
FIG. 4A and 4B are a front view and a side view of the press device in FIG. 4, respectively.
Figure 4B:
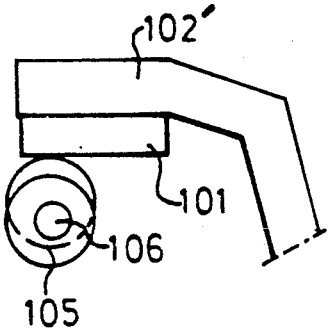

Referring to FIGS. 3, 3A and 3B which are a plane view, a front view and a side view of each plate 13 shown in FIG. 1, respectively, it can be clearly seen that each plate 13 has two throughout holes and that two protrusions 14 from each side wall 20 extend sufficiently through throughout holes 12, so as to be protruded outwardly beyond the plate 13.

Now, the operation of the press device of FIG. 1 according to the present invention will be described in detail.

In printing, the holder 2 hinges or rotates about the shaft 3, in anti-clockwise direction and presses the lower portion of the thermal sensitive head 1 against the platen 5. At this time, the thermal sensitive head 1 is inclined to meet the direction and the angle of the inclination of the platen 5, so that it is in uniform contact with the peripheral surface of the platen 5, throughout the length thereof.

Figures 2, 2A, 2B:
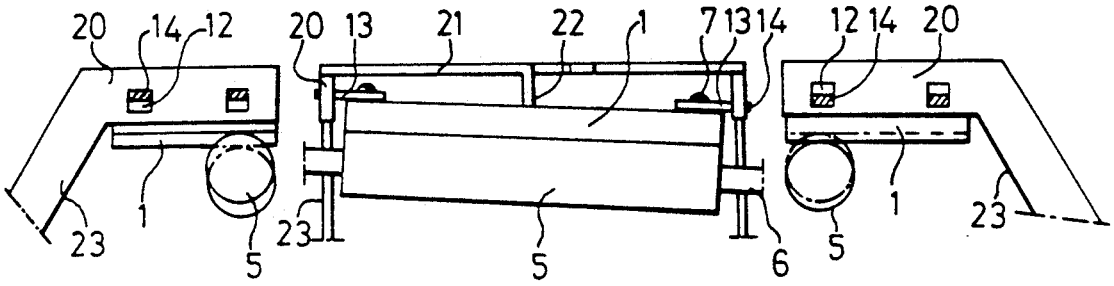
FIGS. 2, 2A and 2B are a front view, a left side and a right side view of the press device in FIG. 1, on the condition that a platen is disposed inclinedly, respectively.

A case where the platen 5 is inclined toward the right, as shown in FIGS. 2, 2A and 2B, is exemplified for explaining the contact state between the thermal sensitive head 1 and the platen 5. In FIG. 2, the thermal sensitive head 1 is inclined downwardly, at its right portion, from the center extension 22, to correspond to the inclination of the platen 5. At this time, protrusions 14 of the plate 13 fixed to the right end of the thermal sensitive head 1 are disposed at respective lower ends of throughout holes 12 formed at the right side wall 20 of the holder 2, as shown in FIGS. 2 and 2A. On the other hand, protrusions 14 of the plate 13 fixed to the left end of the thermal sensitive head 1 are disposed at respective upper ends of throughout holes 12 formed at the left side wall 20 of the holder 2, as shown in FIGS. 2 and 2B.

As a result, the thermal sensitive head pressing device shown in FIG. 1 forces the thermal sensitive head 1 to be inclined to correspond to the direction and the angle of the inclination of the platen 5, so that the thermal sensitive head 1 is in uniform contact with the peripheral surface of the platen 5, throughout the length thereof. As the thermal sensitive head I contacts uniformly the platen 5 throughout the length thereof, the printing quality is improved.

As is apparent from the above description, the present invention provides a press device in a color video printer which is capable of pressing uniformly a thermal sensitive head against a platen. Although the preferred embodiment of the present invention has been disclosed for illustrative purpose, in conjunction with FIG. 1, those skilled in the art will appreciate that various modifications, additions and substitutions are possible, without departing from the scope and spirit of the invention as disclosed in the accompanying claims.

For example, in order to incline the thermal sensitive head 1 according to the direction and angle of the inclination of platen 5, a hinge can be mounted at one end of the thermal sensitive head i instead of one of plates provided at opposite ends of the thermal sensitive head and the center member of holder. Because the embodiment is provided for in the description of the present invention, the present invention is not limited by the embodiment and is defined only in the following claims.

What is claimed is:

1. A thermal print-type printer comprising:

a thermal sensitive head;

a platen being contacted with said thermal sensitive head for feeding a dye film and a printing sheet, said platen being placed under said thermal sensitive head;

a holder formed in a body with a supporting member pivotally moving for forcing said thermal sensitive head to be in contact with said platen and to be separated therefrom, said body having a center member for supporting said thermal sensitive head so as to force a center portion of said thermal sensitive head to be in close contact with said platen; and means for coupling said holder so as to be independently movable upwardly and downwardly at both ends of said thermal sensitive head;

wherein said thermal sensitive head is uniformly pressed onto said platen independently of an inclination of said platen by gravity of said thermal sensitive head, holder and coupling means when said thermal sensitive head is in contact with said platen.

2. A thermal print-type printer as recited in claim 1, wherein said coupling means comprises:

a pair of plates fixedly mounted on opposite ends of said thermal sensitive head, respectively, each of said plates having at least one protrusion extending outwardly from said thermal sensitive head; and two spaced side walls formed in said body of said holder, each of said side walls having at least one throughout hole adapted to receive said one protrusion of each of said plates and to allow upward and downward movement of said least one protrusion;

wherein when said platen is inclined upwardly and downwardly, said at least one protrusion of each of said plates moves upwardly and downwardly within said at least one throughout hole in accordance with said inclination of said platen so that said thermal sensitive head is in uniform contact with said platen over an entire length thereof.

* * * * *